US009908021B2

(12) United States Patent
Wills et al.

(10) Patent No.: US 9,908,021 B2
(45) Date of Patent: Mar. 6, 2018

(54) TURF REPAIR APPARATUS

(71) Applicant: FAB SIX PRODUCTS LLC, Venice, FL (US)

(72) Inventors: Gary Wills, Venice, FL (US); Robert Stein, Jr., Elizabethtown, KY (US)

(73) Assignee: FAB SIX PRODUCTS LLC, Venice, FL (US)

( * ) Notice: Subject to any disclaimer, the term of this patent is extended or adjusted under 35 U.S.C. 154(b) by 0 days.

(21) Appl. No.: 14/987,063

(22) Filed: Jan. 4, 2016

(65) Prior Publication Data

US 2016/0193512 A1 Jul. 7, 2016

Related U.S. Application Data

(60) Provisional application No. 62/099,397, filed on Jan. 2, 2015.

(51) Int. Cl.

| | |
|---|---|
| ***A63B 57/00*** | (2015.01) |
| ***A63B 57/50*** | (2015.01) |
| ***A63B 57/20*** | (2015.01) |
| *A63B 53/10* | (2015.01) |
| *A63B 53/14* | (2015.01) |

(52) U.S. Cl.

CPC ..... *A63B 57/50* (2015.10); *A63B 57/20* (2015.10); *A63B 53/10* (2013.01); *A63B 53/14* (2013.01)

(58) Field of Classification Search

CPC ..... A63B 57/50; A63B 57/20; A63B 53/14; A63B 53/10; B65D 63/1063; B65D 2563/106; B65D 2563/00

See application file for complete search history.

(56) References Cited

U.S. PATENT DOCUMENTS 4,573,242 A * 3/1986 Lankton ..... B65D 63/1081 24/16 PB
4,955,609 A * 9/1990 Kassen ..... A63B 57/50 473/286
6,800,042 B2 * 10/2004 Braithwaite ..... A63B 57/207 473/406
7,303,484 B2 * 12/2007 Bieske ..... A63B 57/50 473/286
7,360,281 B1 * 4/2008 MacCartey ..... B65D 63/1063 24/16 PB
7,621,819 B1 * 11/2009 Neu ..... B43L 23/06 172/375

(Continued)

*Primary Examiner* — Stephen Blau
(74) *Attorney, Agent, or Firm* — Marsh Fischmann & Breyfogle LLP

(57) ABSTRACT

Utilities that allow repairing turf and installing a turf repair tool on a shaft or grip of a golf club. In one aspect, a turf repair tool is disclosed for partial conforming attachment to a golf club grip. The turf repair tool may be irreversibly engaged with the golf club grip to facilitate ergonomic turf repair. The turf repair tool may include one or more prongs that may extend beyond the end of a golf club shaft distal to a golf club head such that a golfer may manipulate a golf club to repair a portion of dislodged turf without kneeling, sitting, or maintaining a position or posture that places excess or undue strain on the golfer. Additionally, the present disclosure includes embodiments that relate to a method of irreversibly installing the turf repair tool on a grip of a golf club.

14 Claims, 7 Drawing Sheets

(56) References Cited

U.S. PATENT DOCUMENTS

D642,029 S * 7/2011 Rollinson ..... A63B 57/50 D8/26
8,616,994 B2 * 12/2013 Kwon ..... A63B 55/10 473/283
8,757,562 B2 * 6/2014 Fujiwara ..... B60R 16/0215 24/16 PB
8,955,198 B2 * 2/2015 Carnevali ..... B65D 63/1063 24/16 PB
9,555,943 B2 * 1/2017 Breen, IV ..... B65D 63/1063
2003/0216190 A1 * 11/2003 Wang ..... A63B 47/02 473/286
2004/0134116 A1 * 7/2004 Axelrod ..... A63B 53/007 43/22
2005/0014572 A1 * 1/2005 Lisby, Jr. ..... A63B 47/02 473/286
2005/0170904 A1 * 8/2005 Smeeth ..... A63B 47/02 473/286
2006/0025230 A1 * 2/2006 Zeuch ..... A63B 57/50 473/286
2006/0063614 A1 * 3/2006 Bellagamba ..... A63B 57/50 473/408
2007/0049397 A1 * 3/2007 Bieske ..... A63B 57/50 473/286
2007/0082758 A1 * 4/2007 Widmann ..... A63B 57/207 473/406
2008/0066504 A1 * 3/2008 Matsushita ..... B65D 63/10 70/58
2008/0230435 A1 * 9/2008 Cope ..... A63B 57/00 206/579
2012/0084948 A1 * 4/2012 Breen, IV ..... B65D 63/1063 24/16 R
2014/0349783 A1 * 11/2014 Haley ..... A63B 57/0075 473/406
2016/0193512 A1 * 7/2016 Wills ..... A63B 57/50 473/408

* cited by examiner

FIG. 7A
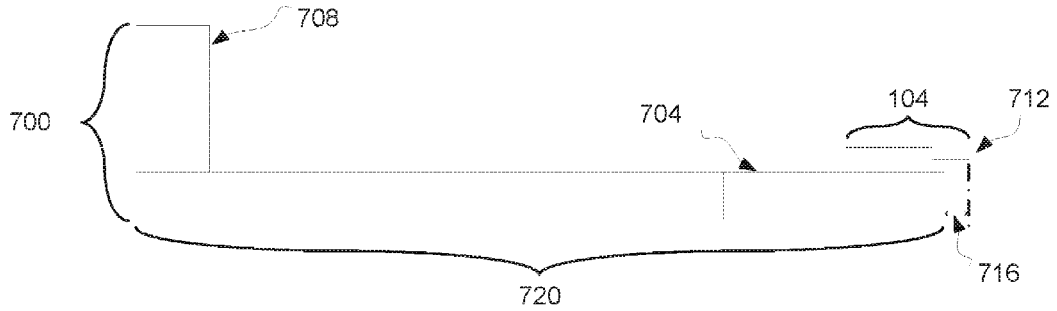
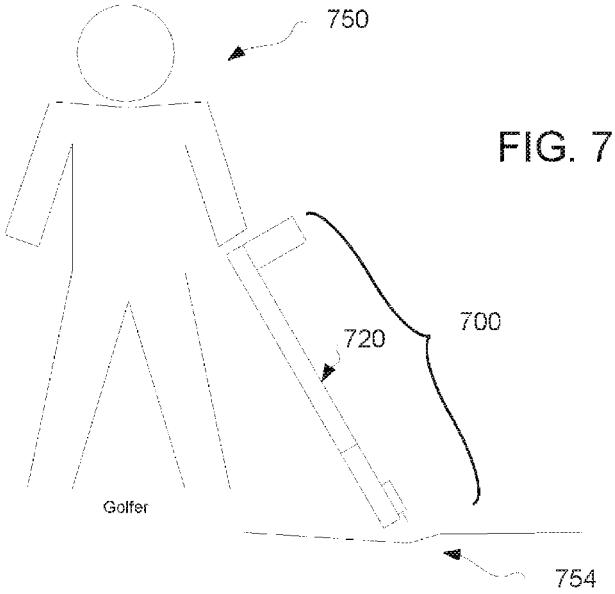
FIG. 7B

TURF REPAIR APPARATUS

CROSS-REFERENCE TO RELATED APPLICATION

This application claims priority from U.S. Provisional Application No. 62/099,397 filed on Jan. 2, 2015, entitled "TURF REPAIR APPARATUS," the contents of which are incorporated by reference herein as if set forth in full.

FIELD

The present disclosure relates generally to implements used during a game of golf and, more particularly, to systems and methods for attaching and using a turf repair tool to repair a portion of dislodged turf during a game of golf.

BACKGROUND

A typical game of golf may result in the creation of divots (i.e., dislodged portions of turf) in a golf course. For example, a golf ball advanced onto a golf green may create a ball-mark divot upon impact of the golf ball with the golf green. The ball-mark divot may alter, for example, the contour of the golf green in an undesirable manner. As another example, swinging a golf club may inadvertently result in excess contact of the golf club with the golf course such that the golf club dislodges a portion of turf to create a fairway divot. In any event, a golf course typically requires a golfer to repair a divot or any such dislodged portion of turf during a golf game so as to restore the golf course for subsequent golfers.

It is often desirable to use one or more implements or tools to repair turf (e.g., a ball-mark divot, a fairway divot, etc.). Traditionally, this involved retrieving a small implement (e.g., in the range of 4 inches by 1 inch) having a pronged end and manually repairing the turf by engaging the small implement at the boundaries of the dislodged turf. Notably, because the small implement is hand-held, a golfer is required to maneuver the implement to the dislodged turf for repair (e.g., lower the implement to the ground). In some instances, lowering the implement to the dislodged turf may involve sitting, crouching, or other postures that could be uncomfortable or painful. Furthermore, the implement may become misplaced or lost.

Retrieving the foregoing described small implement to repair a divot is undesirable in several respects. One is simply the inconvenience of retrieving the implement during a game of golf. For example, while the implement may be stored in a golf bag, the golfer may require the implement while substantially away from the golf bag (e.g., while on approach to a golf green or on a golf green, as discussed in greater detail below). A golfer's return to the golf cart (e.g., to retrieve the implement from the golf bag) during a golf game may cause unnecessary interruption and delay. Moreover, the small nature of the implement may create barriers to identifying and/or accessing the implement upon return to a golf cart, for example. Another is the inconvenience of the golfer contorting into a position required to interface the implement with the dislodged turf. That is, traditional implements may require a golfer to repair a divot in an ergonomically incorrect manner.

SUMMARY

In view of the foregoing, the present disclosure is generally directed to various embodiments of a turf repair tool. In certain embodiments of the turf repair tool described herein, improvements directed to repairing a dislodged portion of turf via a turf repair tool attached to a shaft or grip of a golf club are presented. In this regard, the turf repair tool may be irreversibly attached adjacent to a golf club grip located distal to a golf club head. The turf repair tool may include one or more prongs that may be extendable beyond the end of the golf club shaft such that the turf repair tool may be engaged with turf to repair. A golfer may manipulate the golf club associated with the turf repair tool to repair turf without kneeling, sitting, or maintaining a position or posture that places excess or undue strain on the golfer. The present disclosure also contemplates embodiments directed to installing the turf repair tool on a grip of a golf club such that the turf repair tool may be irreversibly engaged with the golf club grip.

In this regard, a first aspect of the present disclosure includes a tool for use in a system for repair of turf, where the system includes a golf club with a golf club grip. The tool includes a body member such that the body member includes a recess for receiving the golf club grip. The tool further includes a tool member disposed on a first surface of the body member. The tool further includes a fastener member for irreversible engagement of the body member to the golf club grip. The fastener member further includes a fastener member first end and a fastener member second end such that the fastener member is connected to the body member at the fastener member first end. The body member further includes a channel for non-removable capture of the fastener member second end upon advancement of the fastener member second end into the channel.

A number of feature refinements and additional features are applicable in the first aspect. These feature refinements and additional features may be used individually or in any combination. As such, each of the following features that will be discussed may be, but are not required to be, used with any other feature combination of features of the first aspect.

For example, in an embodiment, the recess of the tool may further include at least one stud disposed for contactable engagement with a gripping material of said golf club grip. Notably, according to another embodiment, the tool member may be pivotally attached to the body member at the body member first surface. The tool member of the tool may further include a base member and a protrusion member. The protrusion member may be fixedly connected to the base member about a first edge of the base member such that the protrusion member is angularly offset from a first reference plane defined by a first planar surface of the tool member. The protrusion member may include at least one prong.

In an embodiment, the tool member may be movable about the pivotal attachment between a first and a second position. In this regard, the tool member may be substantially parallel with the golf club grip while in the first position. Additionally, the tool member may extend beyond a golf club first end distal to a golf club head while in the second position. The tool member may further include an arcuate groove with a bulbous portion for receiving a knob of the body member such that said received knob removably interlocks said tool in said second position.

In some embodiments, the fastener member second end further includes a series of angled indentations. Notably, the body member may further include the channel for non-removable capture of the fastener member second end upon advancement of at least one of the series of angled indentations into the channel.

In this regard, a second aspect of the present disclosure includes a tool attachable to a grip of a golf club. The tool includes a body member such that the body member includes a concave recess disposed in a receiving surface of the body member. The recess may include at least one stud. The tool further includes a tool member disposed on an exposed surface of the body member. The tool further includes a fastener member such that the fastener member includes a fastener member first end and a fastener member second end. The fastener member may be connected to the body member at the fastener member first end. Additionally, the body member further includes a channel for non-removable capture of the fastener member second end upon advancement of the fastener member second end into the channel.

A number of feature refinements and additional features are applicable in the second aspect. These feature refinements and additional features may be used individually or in any combination. As such, each of the following features that will be discussed may be, but are not required to be, used with any other feature combination of features of the second aspect.

For example, in an embodiment, the recess of the tool includes at least one open port transverse to the exposed surface. In another embodiment, the tool member may be pivotally attached to the body member at the body member exposed surface. Additionally, the tool member may further include a base member and a protrusion member such that the protrusion member may be fixedly connected to the base member about a first edge of the base member. Accordingly, the protrusion member may be angularly offset from a first reference plane defined by a first planar surface of the tool member. The protrusion member may further include at least one prong.

In another embodiment, the tool member may be movable about the pivotal attachment between a first and a second position. In this regard, the tool member may be substantially parallel with the body member while in the second position and the tool member may extend beyond a golf club first end distal to a golf club head while in the second position. The tool member may further include an arcuate groove with a bulbous portion for receiving a knob of the body member such that the received knob removably interlocks the tool in the second position.

According to another embodiment, the fastener member includes a series of angled indentations between the fastener member first end and the fastener member second end. In this regard, the body member may further include the channel for non-removable capture of the fastener member second end upon advancement of at least one of the series of angled indentations into the channel.

A third aspect includes a method of installing a turf repair tool on a grip of a golf club. The method includes positioning a receiving surface of a body member of the turf repair tool over a projection of the grip of the golf club. The method further includes inserting a free end of a fastener member through a channel of the body member for non-removable capture of the fastener member upon advancement of the free end into the channel. Additionally, the fastener member further includes a fixed end opposite the free end and connected to a first surface of the body member such that the channel is disposed at a second surface of the body member.

A number of feature refinements and additional features are applicable in the third aspect. These feature refinements and additional features may be used individually or in any combination. As such, each of the following features that will be discussed may be, but are not required to be, used with any other feature combination of features of the third aspect.

For example, the method may further include advancing the free end through the channel such that the receiving surface of the body member may be substantially flush against the grip of the golf club. Additionally, the positioning may further include setting at least one stud of the receiving surface into the projection of the grip of the golf club. In some instances, the projection may include a rubber gripping material. The method may further include severing the fastener member at a point adjacent to the channel and proximal to the free end.

In other embodiments, a tool member may be pivotally attached to the body member at an exposed surface of the body member. The tool member may include a base member and a protrusion member such that the protrusion member may be fixedly connected to the base member about a first edge of the base member. Accordingly, the protrusion member may be angularly offset from a first reference plane defined by a first planar surface of the tool member. The protrusion member may further include at least one prong.

Additionally, the tool member may be movable about the pivotal attachment between a first and a second position. In this regard, the tool member may be substantially parallel with the grip while in the first position and the tool member may extend beyond a golf club first end distal to a golf club head while in the second position. Additionally, the tool member may further include an arcuate groove with a bulbous portion for receiving a knob of the body member such that the received knob removably interlocks the tool in the second position.

In other embodiments, the fastener member may further include a series of angled indentations between the fastener member first end and the fastener member second end. Accordingly, the body member may further include the channel for non-removable capture of the fastener member second end upon advancement of at least one of the series of angled indentations into the channel.

BRIEF DESCRIPTION OF THE DRAWINGS

FIG. 7A illustrates a system embodiment of a golf club with the turf repair tool of FIG. 2.

FIG. 7B illustrates a system embodiment of a golfer manipulating the golf club of FIG. 7A to repair a portion of dislodged turf.

DETAILED DESCRIPTION

Disclosed herein are utilities (e.g., systems, process, apparatuses, etc.) for repairing turf and installing a turf repair tool on a shaft or grip of a golf club (e.g., the turf repair tool adjacent to a grip located distal to a golf club head). The disclosed utilities employ a body member with a recess for partial conforming attachment to a golf club grip (e.g., to mate the turf repair tool on to the golf club grip), and a fastener member for irreversible engagement of the body member with the golf club shaft (e.g., to secure the turf repair tool to the golf club grip). The secured turf repair tool may also include a tool member disposed on a first surface of the body member. Notably, the tool member may include one or more prongs that may be extended beyond the end of the golf club shaft (e.g., at an end of the golf club shaft distal to the golf club head) such that the tool member may be engaged with turf to repair, for example, a ball-mark divot or a fairway divot. In this regard, a golf club with the secured turf repair tool may be used to repair turf on a golf course.

Reference will now be made to the accompanying drawings, which assist in illustrating the various pertinent features of the various novel aspects of the present disclosure. The following description is presented for purposes of illustration and description. Furthermore, the description is not intended to limit the inventive aspects to the forms disclosed herein. Consequently, variations and modifications commensurate with the following teachings, and skill and knowledge of the relevant art, are within the scope of the present inventive aspects.

Figure 1:
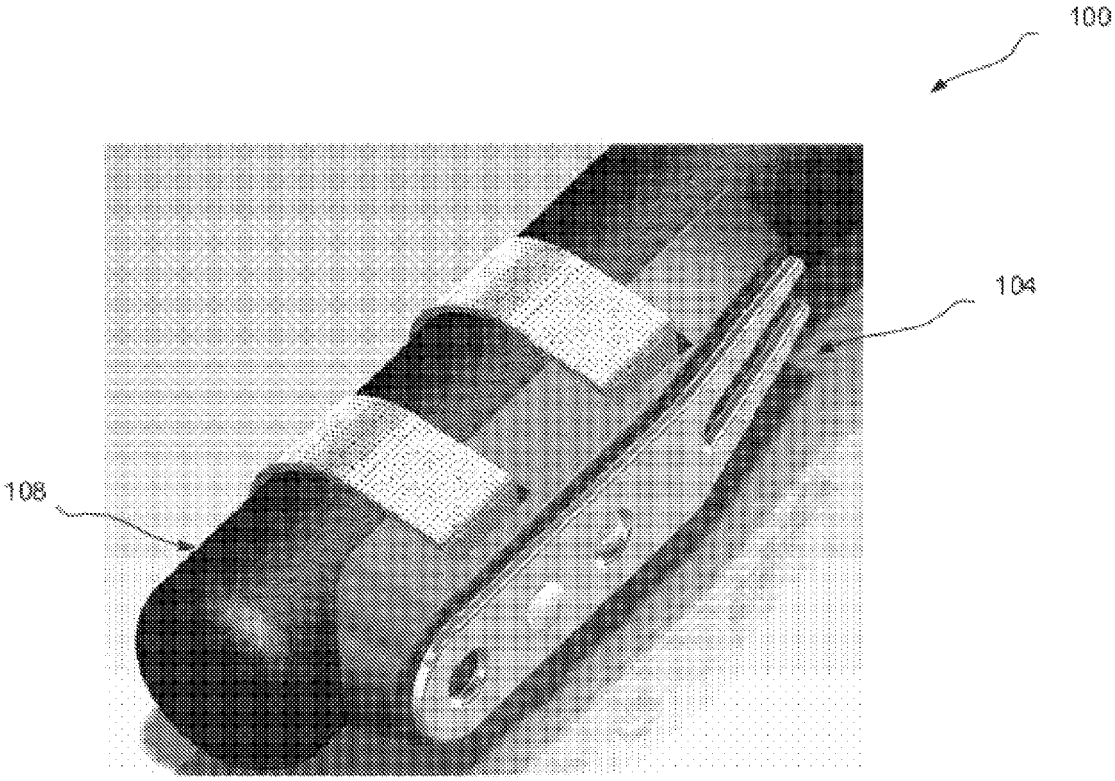
FIG. 1 depicts a turf repair tool in a system including a golf club with a golf club shaft.

In this regard, FIG. 1 presents a system isometric view 100 of the turf repair tool 104 and golf club shaft 108. Broadly, the turf repair tool 104 may be used in a system including a golf club (partially pictured) with a golf club shaft 108, as discussed in greater detail below with reference to FIG. 7A. The golf club may be a club used during a game of golf including, for example, a putter. In this regard, the turf repair tool 104 may be readily accessible during a game of golf, especially on a golf green where a putter is mostly utilized. This may facilitate turf repair by eliminating the need to access a separate tool during a game of golf for turf repair. This may be particularly beneficial when a golfer dislodges turf with a golf club equipped with an attached turf repair tool, or where the golfer presently carriers another golf club equipped with an attached turf repair tool. This may occur, for example, where a golfer advances a golf ball to a golf green (i.e., an area of prepared grass around a golf hole) such that a ball-mark divot is created on the golf green. The turf repair tool 104 may be attached to the putter such that the golfer may approach the golf green to both repair the ball-mark divot and advance the golf ball to the golf hole without return to the golf cart. Notably, the turf repair tool 104 attached to the putter may not hinder the use of the putter to advance the golf ball into the golf hole. In other instances, the turf repair tool 104 may facilitate repair of a fairway divot.

In some instances, the attachment of the turf repair tool 104 to the golf club may facilitate ergonomic turf repair. That is, due in part to the association of the turf repair tool with the golf club, the golfer may effectively use the golf club shaft as an implement by which to maneuver or otherwise manipulate the turf repair tool. For example, and with reference to FIG. 7A, the turf repair tool 104 may be attached to a putter 700 at a proximal end of the club 704 opposite the club head 708. In this regard, the turf repair tool 104 may be attached to putter 700 adjacent to the proximal end of the club 704 located on an end opposite putter head 708. According to one embodiment, the turf repair tool may include one or more prongs 712 that extend a distance 716 beyond the proximal end of the putter shaft 720 for engagement with a dislodged portion of turf.

Turning next to FIG. 7B, the putter 700 may be manipulated by a golfer 750 to facilitate ergonomic turf repair. According to one embodiment, the golfer 750 may manipulate putter 700 with attached turf repair tool 104 via putter head 708, or generally via putter shaft 720, such that turf repair tool 104 engages a dislodged portion of grass 754. As such, the turf repair tool 104 may interface with the dislodged portion of grass 754 while the golfer 750 remains in a substantially upright position. In turn, the turf repair tool 104 may allow the golfer 750 to repair the dislodged turf 754 without kneeling, sitting, or maintaining a position or posture that places excess or undue strain on the golfer.

Figure 2:
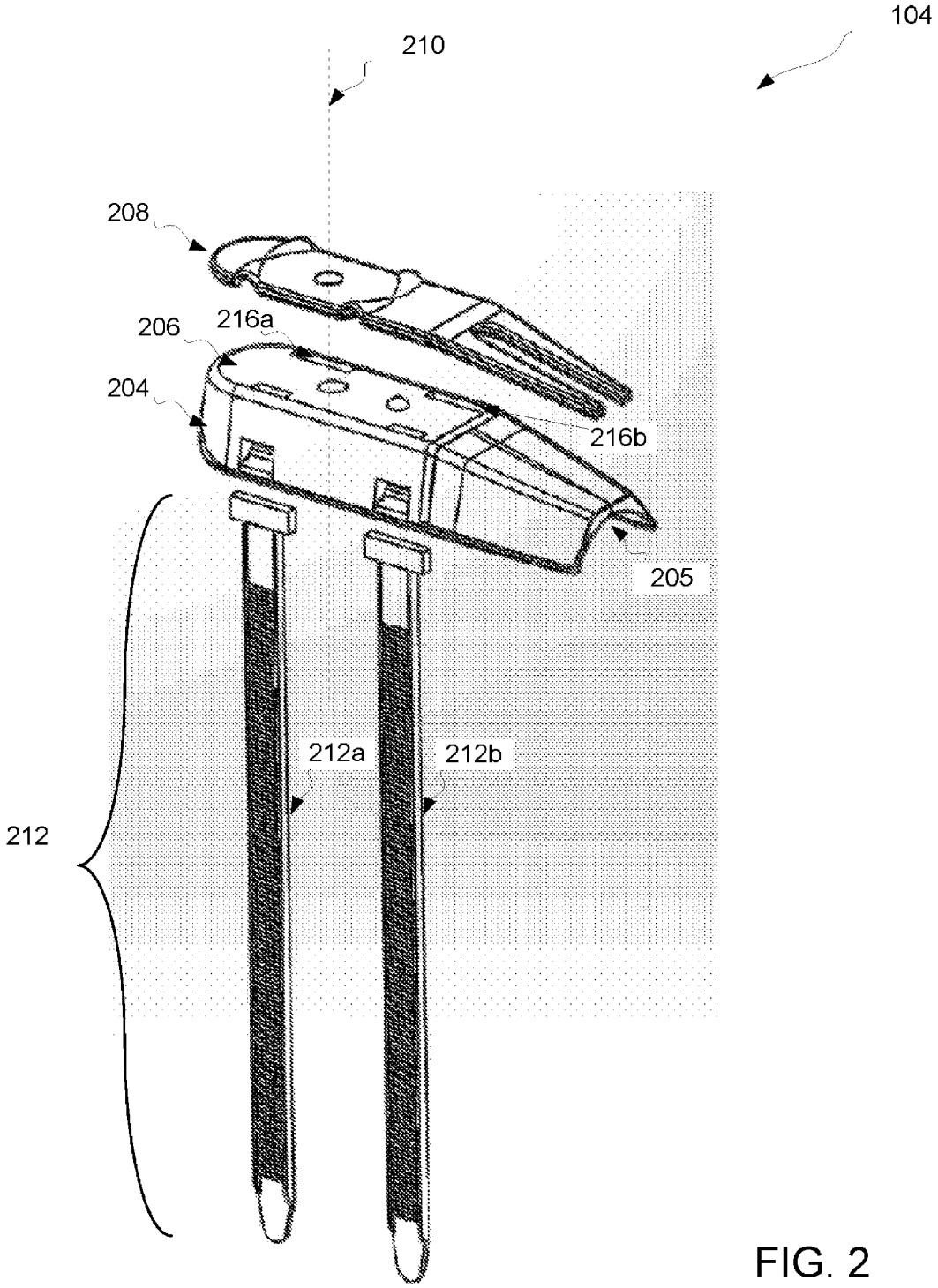
FIG. 2 is an expanded assembly view of the turf repair tool attachable to a golf club.

Turning now to FIG. 2, an expanded assembly view of an embodiment of turf repair tool 104 is depicted in a state where the turf repair tool 104 is not attached to golf club shaft 108. The turf repair tool 104 may include body member 204 for placement relative to a golf club shaft 108. A tool member 208 may be disposed on a first surface 206 of the body member 204 opposite that of a surface 205 for partially conforming placement adjacent to, for example, the proximal end of the club 704 (not shown in FIG. 2). In some embodiments, the tool member 208 may be rotatable around an axis 210 transverse to the first surface 206. In this regard, the tool member may be selectively extendable, discussed in greater detail below, from a first position to a second position such that a portion of the tool member 108 may extend beyond an edge of golf club shaft 720 distal to the golf club head to engage a portion of dislodged turf to facilitate repair.

The turf repair tool 104 may also include one or more fastener members 212 for irreversible engagement of the body member 204 to the golf club shaft 108. In some embodiments, the fastener member 212 may include a first fastener member 212*a* and a second fastener member 212*b* as depicted in FIG. 2. In any case, and as will be discussed in greater detail below with reference to FIG. 5, the body member 204 may include one or more channels 216 (e.g., channel 216*a*, 216*b*) for nonremovable capture of a fastener member 212 upon advancement of the fastener member 212 into the channel. For example, the fastener member 212 may include a series of angled indentations which may preclude removing the faster member 212 from the channel upon advancement therein. Accordingly, the turf repair tool 104 may be irreversibly secured to the golf club shaft 108 via the fastener member 212 at a position adjacent to a golf club grip located distal to a golf club head. By irreversibly secured, it is meant that the turf repair tool 104 may not be removed without destroying the fastener member 212.

Figure 3:
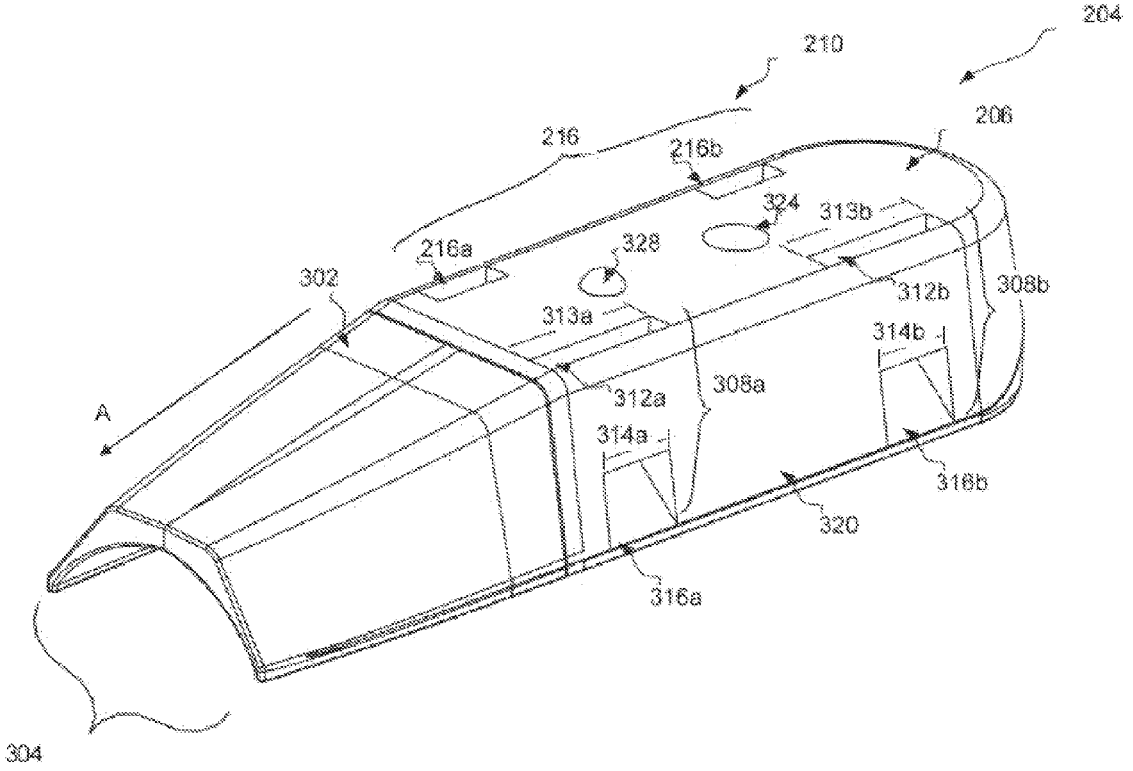
FIG. 3 is a detailed view of a body member of the turf repair tool of FIG. 2.

Turning next to FIG. 3, a detailed isometric view of body member 204 is depicted. Body member 204 may generally comprise a rectilinear body. In some embodiments, body member 204 may include tapered surface 302 such that body member first surface 206 may be tapered generally according to arrow A. In this regard, as used herein, the arrow A may identify a direction of decreasing thickness of body member 204 to define a tapered surface 302 extending between body member first surface 206 and golf club shaft 108. Body member 204 may include a concave recess 304 for receiving the golf club shaft 108 that extends substantially along a longitudinal axis of the body member 204 opposite to the body member first surface 206 (e.g., for at least partial conforming placement adjacent to a grip of a golf club shaft positioned distal to a golf club head). In this regard, recess 304 may have an arcuate profile extending along the turf repair tool 104 for engagement with a generally tubular shaft and may be of any appropriate configuration in order to receive the golf club shaft 108. The recess 304 may include a stud 306 (not pictured) extending from the recess 304 disposed for contactable engagement with a gripping surface of a golf club shaft 108 distal to a golf club head. In this regard, the stud 306 may be of sufficient size, shape, and material such that stud 306 engages (e.g., penetrates) a gripping surface of the golf club shaft 108 to prevent lateral or rotational movement about or along the golf club shaft 108. In some embodiments, recess 304 may include multiple studs 306.

Figure 5:
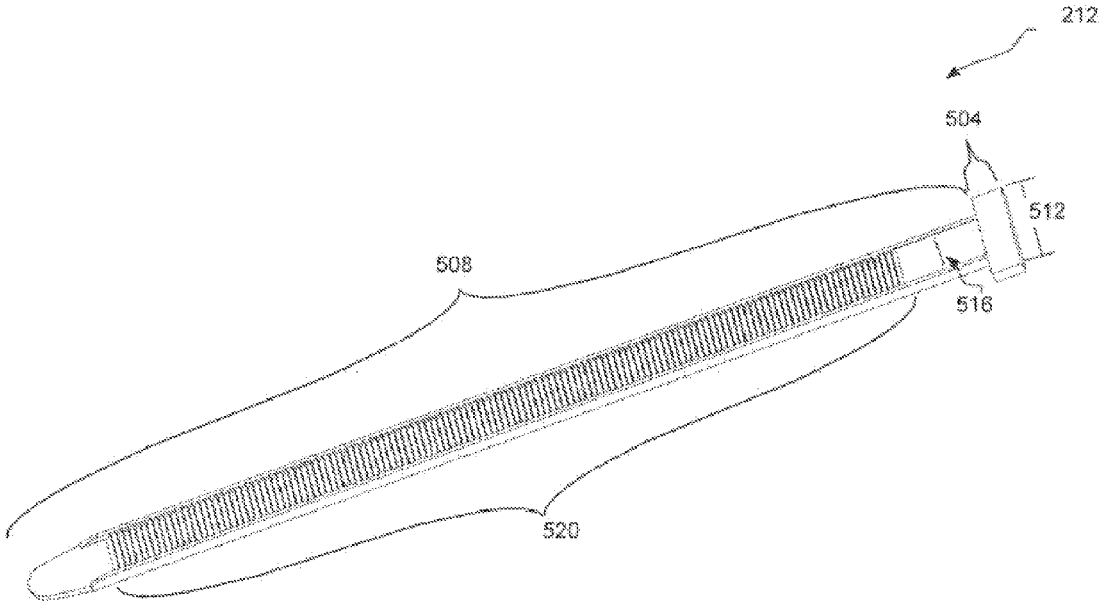
FIG. 5 is a detailed isometric view of a fastener member of the turf repair tool of FIG. 2.

The body member 204 may include one or more ports, such as port 308*a* and port 308*b*, for connecting the fastener member 212 to body member 204. Each port may include a first opening and a second opening. Specifically, port 308*a* may include a first opening 312*a* disposed on the body member first surface 206, and a second opening 316*a* disposed on a second surface 320 of the body member 204 transverse to the receiving surface 304 and body member first surface 206. Similarly, port 308*b* may include a first opening 312*b* disposed on the body member first surface 206 and a second opening 316*b* disposed on a surface of the body member 204 transverse to the receiving surface 304 and body member first surface 206. In this regard, the fastener member 212 may be connected to the body member 204 by advancement into, for example, first opening 312*a* at first surface 206 and out of second opening 316*a* at second surface 320. For example, fastener member 212, as depicted in FIG. 5, may be advanced into first opening 312*a* at first surface 206 to connect fastener member 212 to body member 204.

The first opening 312*a* may include a first opening width 313*a* and the second opening 316*a* may include a second opening width 314*a*. In some embodiments, first opening width 313*a* may be greater than second opening width 314*a* to facilitate connection of fastener member 212 to body member 204. Specifically, and as will be discussed in greater detail below, a fastener member 212 may be provided with a differential width so as the fastener member 212 may pass through port 308*a*, for example, until the fastener member 212 reaches the differential width (e.g., a width of fastener member 212 less than or equal to first opening with 313*a*, but greater than second opening width 314*a*). For example, and with return reference to FIG. 5, fastener member second end of fastener member 212 may be advanced into first opening 312*a* and out of second opening 316*a* until fastener member first end 504 is substantially advanced into first opening 312*a*. Second opening 316*a* may include a second opening width 314*a* less than that of a fastener member first end width 516 such that fastener member 212 is precluded from advancing further, upon fastener member first end 504 arriving substantially in the first opening 312*a*. Port 308*b* may include geometry analogous to port 308*a*.

As previously noted with respect to FIG. 2, body member 204 may include one or more channels 216, such as channel 216*a* and 216*b*, for nonremovable capture of the fastener member 212. In particular, each channel 216 may employ one or more locking mechanisms (not pictured) for nonremovable capture of the fastener member 212 upon the advancement of fastener member 212 into a channel 216. That is, upon advancement of fastener member 212 into channel 216, the fastener member 212 may proceed further into channel 216 but may not proceed out of channel 216 (e.g., the series of angled indentations 520 of fastener member 212 may preclude reversible movement relative to channel 216 upon advancement therein). In this regard, discussed in greater detail below, the combination of, for example, port 308*a* and channel 216*a* may facilitate irreversible engagement of the body member 204 to the golf club grip via one or more fastener members 212.

As previously discussed with respect to FIG. 2, body member 204 may include an axis 210 transverse to body member first surface 206. Mounting member 324 may facilitate the attachment of tool member 208 to body member 204. According to one embodiment, the mounting member 324 may facilitate the pivotal attachment of tool member 208 to body member 204 such that tool member 208, discussed in greater detail below, may rotate about axis 210. Body member 204 may also include a knob 328 disposed on the body member first surface 206. In some instances, knob 328 may engage with portions of tool member 208 to facilitate selective rotation of tool member 208 about axis 210.

Figure 4:
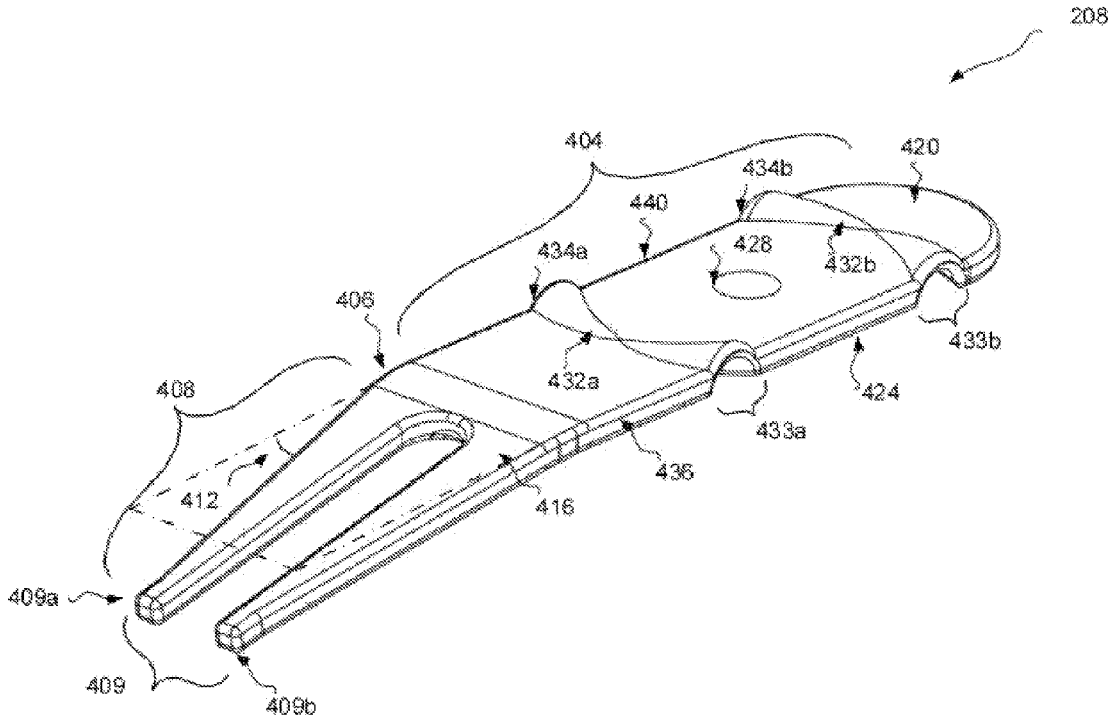
FIG. 4 is a isometric view of a tool member of the turf repair tool of FIG. 2.

Turning now to FIG. 4, a detailed isometric view of tool member 208 is depicted in a state where the tool member 208 is not attached to body member 204. Tool member 208 may comprise a tool member base member 404 and a tool member protrusion member 408. Broadly, tool member base member 404 may be substantially planar in shape and facilitate the attachment of the tool member 208 to body member 204. The tool member protrusion member 408 may facilitate turf repair by providing a surface by which to engage a portion of dislodged turf. In some instances, the provided surface for engaging a portion of dislodged grass may comprise one or more prongs 409, such as prong 409*a* and prong 409*b*. The tool member base member 404 and tool member protrusion member 408 may be integrally attached about a first edge 406. In some embodiments, the tool member protrusion member 408 may be angularly offset by an offset angle 412 from a first reference plane 416. The reference plane 416 may be defined by a plane coplanar with tool member base member 404. The offset angle 412 of tool member protrusion member 408 may provide additional leverage or mechanical advantage during turf repair. That is, the offset angle 412 may effectively create a lever such that the force applied at the site of the dislodged turf is multiplied as a function of the offset angle 412.

Tool member base member 404 may include a tool member base member first surface 420 and a tool member base member second surface 424. Tool member 208 may be disposed on body member first surface 206 such that tool member base member second surface 424 is proximal to body member 204. The tool member 208 may include a complementary mounting member 428 complementary to the mounting member 324 of body member 204 for attachment about axis 210. The axis 210 may be disposed in a direction transverse to body member first face 206. In this regard, in some embodiments, tool member 208 may be pivotally attached to body member 204 at complementary mounting member 428. In some instances, complementary mounting member 428 may comprise an opening extending between tool member base member first surface 420 and tool member base member second surface 424 for receiving, for example, an attachment portion, such as a pin (not pictured), for pivotally attaching the tool member 208 to base member 204.

In some embodiments, tool member 208 may include one or more arcuate grooves (e.g., 432*a*, 432*b*) disposed on tool member base member second surface 424 to engage knob 328 of base member 204. As such, the arcuate grooves may extend between a second edge 436 of tool member base member 404 and a third edge 440 of tool member base member 404 such that knob 328 may, for example, be received by tool member base member 404 via arcuate groove 432*a*. Of note, second edge 436 and third edge 440 may be substantially parallel to each other and transverse to first edge 406. In this regard, arcuate groove 432*a* may form a first arcuate groove opening 433*a* disposed at second edge 436 and a second arcuate groove opening 434*a* disposed at third edge 440. Similarly, arcuate groove 432*b* may form a third arcuate groove opening 433*b* disposed at second edge 436 and a fourth arcuate groove opening 434*b* disposed at third edge 440. In some instances, arcuate groove 432*a* and arcuate groove 432*b* may be substantially symmetrical about the axis 210. Arcuate grooves 432*a* and 432*b* may protrude from tool member base member first surface 420 to form a convex projection at the tool member base member first surface 420 along the length of the arcuate groove 432*a* between the first arcuate groove opening 433*a* and a second arcuate groove opening 434*a*, for example.

Each of the arcuate grooves 432*a* and 432*b* may include a bulbous portion (not pictured) disposed at tool member base member second surface 424 for engaging knob 328 such that the tool member 208 may be removably interlocked into a second position corresponding to the relative position of engaged knob 328. In this regard, in conjunction with the pivotal attachment of tool member 208 at axis 210, the tool member 208 may be operable to rotate between a first position and a second position. The engaged knob 328 may facilitate selective rotation of tool member 208 between a first position and a second position about axis 210. In some embodiments, the tool member 208 may be rotated about axis 210 and removably interlocked at a second position relative to the position of engagement of knob 328 at bulbous portion within the corresponding arcuate members 432*a* and 432*b*. In other embodiments, the tool member 208 may be substantially parallel with the golf club shaft 108 when in the first position. Rotating the tool member 208 axially 180°, in either direction, may place the tool member 208 in the second position such that at least a portion of the tool member 208 extends beyond the end of the golf club shaft distal to the golf club head. In this regard, the tool member 208 may engage a dislodged portion of turf for repair when in the second position.

Turning next to FIG. 5, a detailed isometric view of the fastener member 212 is depicted. Fastener member 212 may generally include a fastener member first end 504 and a fastener member second end 508. Fastener member first end 504 may consist of a fastener member first end width 512 and fastener member second end 508 may consist of a fastener member second end width 516. In some instances, fastener member second end width 516 may be less then fastener member first end width 512. The differential width may facilitate, as discussed in greater detail below, connection of the fastener member first end 504 to body member 204 via, for example, port 308*a* or 308*b*. Fastener member second end 508 may include a series of angled indentations 520 to facilitate the nonremovable capture of the fastener member second end 508 upon advancement into channel 216, for example, of body member 204.

As previously noted, fastener member 212 may facilitate irreversible engagement of the body member 204 to the golf club shaft 108. In some embodiments, fastener member first end 504 may be connected to the body member 204 via a port of the body member, such as port 308*a*, for example. In this regard, fastener member second end 508 may be advanced into first opening 312*a* and out of second opening 316*a* such that fastener member first end 504 advances into first opening 312*a* until fastener member first end 504 interfaces with second opening 316*a*. Because fastener member first end 504 may include a first end width 512 that is greater than second opening width 316*a*, the fastener member 212 may be precluded from further advancement through port 308*a* upon fastener member first end 504 interfacing with second opening 316*a*. The fastener member 212 may be maneuvered over, for example, a golf club grip such that fastener member 212 encircles a substantially tubular circumference of the golf club grip. Fastener member second end 508 may be advanced through a channel of the body member 204, such as channel 216*a* or 216*b*, for non-removable capture of the fastener member 212 upon the advancement of fastener member second end 508 into the channel. The fastener member second end 508 may be advanced into the channel 216*a*, for example, until the body member 204 is irreversibly engaged with the golf club grip.

Figure 6:
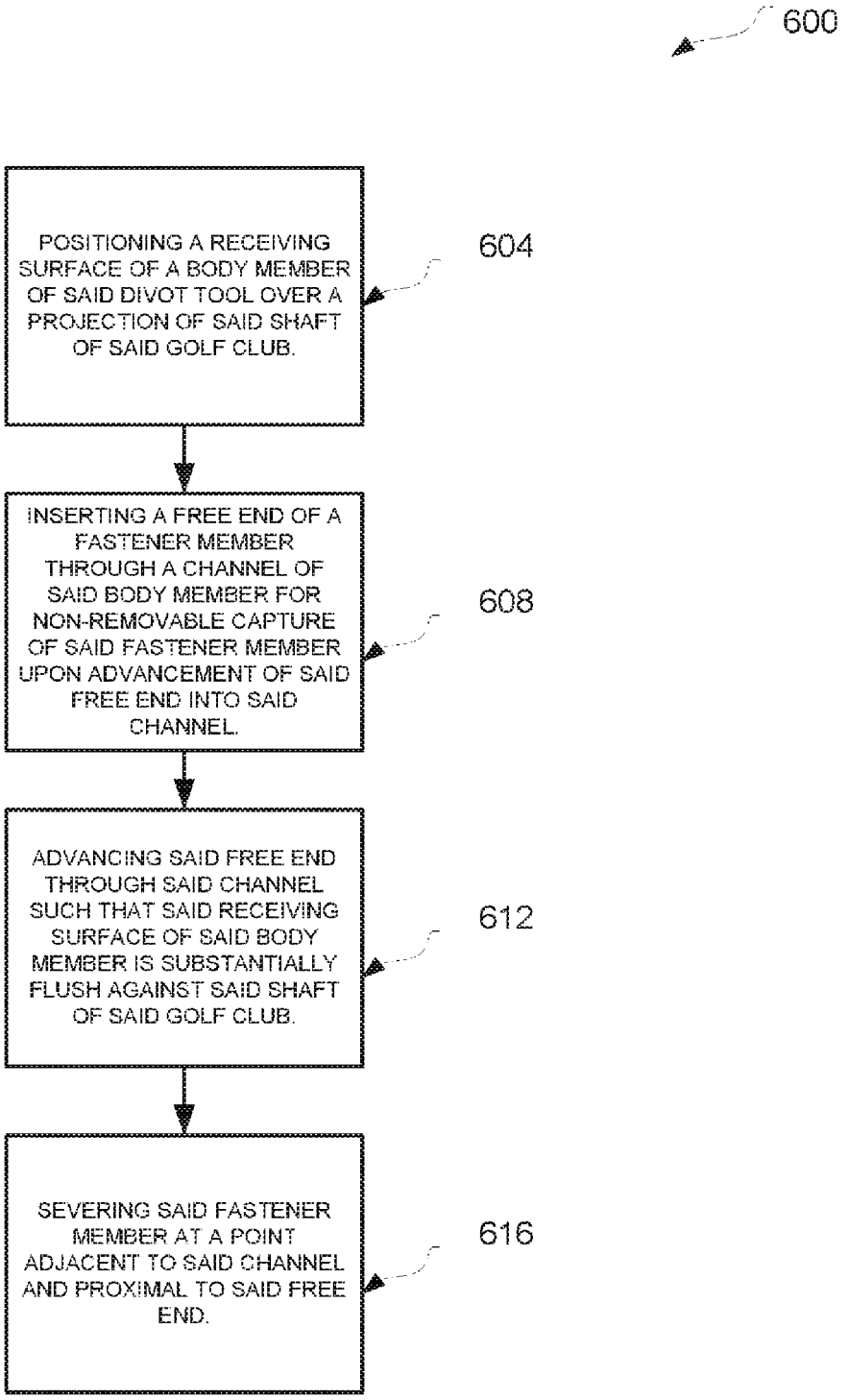
FIG. 6 illustrates with a flow diagram a method of installing the turf repair tool of FIG. 2 on a shaft of a golf club.

To facilitate the reader's understanding of the various functionalities of the utilities discussed herein, reference is now made to the flow diagram in FIG. 6, which illustrates a method 600, for use in installing a turf repair tool on a grip of a golf club. While specific steps (and orders of steps) of the method 600 will be illustrated and discussed, other methods (including more, fewer, or different steps than those illustrated) consistent with the teachings presented herein are also envisioned and encompassed with the present disclosure.

With reference to FIG. 6, method 600 relates generally to installing a turf repair tool (e.g., turf repair tool 104) on a grip of a golf club distal to a golf club head. The steps of method 600 may occur at any golf club used in a golf game, including a putter. The method 600 may include positioning 604 a receiving surface (e.g., recess 304) of the body member 204 of the turf repair tool 104 over a projection of the golf club grip. Notably, the receiving surface may be positioned on the golf club grip distal to the golf club head. The projection of golf club grip may comprise a variety of shapes, including a substantially tubular configuration. In some embodiments, a golf club grip may be wrapped in a rubber gripping material.

The method 600 may continue by inserting 608 a free end (e.g., fastener member second end 508) of the fastener member 212 into a channel (e.g., 216*a*, 216*b*) of the body member 204 for non-removable capture of the fastener member 212 upon advancement of the free end of the fastener member 212 into the channel. In some embodiments, the fastener member 212 may include a fixed end (e.g., fastener member first end 504), opposite the free end, connected to a first surface of the body member (e.g., body member second surface 320). In this regard, the channel may be disposed at a second surface of the body member 204 opposite that of the first surface. The method 600 may continue by advancing 612 the free end (e.g., fastener member second and 508) through the channel (e.g., channel 216*a*, 216*b*) such that the receiving surface (e.g., recess 304) of the body member is substantially flush against the grip of the golf club. As such, the fastener member 212 may facilitate irreversible engagement of the body member 204 to the golf club shaft 108. The method 600 may continue by severing 616 the fastener member 212 at a point adjacent to the channel and proximate to the fastener member free end. In this regard, the turf repair tool 104 may be attached to various golf club grips of differing sizes and with different golf club grip geometries. That is, the fastener member 212 may be of sufficient length to encircle the circumference of a variety of golf club grip configurations. By severing the fastener member 212 at a point adjacent to the channel and proximate to the fastener member free end, the fastener member 212 may be tightened around a golf club grip such that excess fastener member 212 length (e.g., a portion of fastener member 212 which extends beyond channel 216*a*) is removed. The removed portion of the fastener member 212 may facilitate continued normal use of the golf club of which the turf repair tool 104 is attached.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, or within the scope of the present invention. The embodiments described herein above are further intended to explain best modes known of practicing the invention and to enable others skilled in the art to utilize the invention in such, or other embodiments, and with various modifications required by the particular application(s) or use(s) of the present invention it is intended that the appended claims be construed to include alternative embodiments to the extent permitted by the prior art.

What is claimed is:

1. A tool for use in a system for repair of turf, said system including a golf club with a golf club grip, comprising:

a body member, wherein said body member includes a recess for receiving said golf club grip;

a tool member disposed on a first surface of said body member; and a fastener member for irreversible engagement of said body member to said golf club grip, wherein said fastener member includes a fastener member first end and a fastener member second end, and wherein said fastener member is connected to said body member at said fastener member first end, wherein said body member includes a channel for non-removable capture of said fastener member second end upon advancement of said fastener member second end into said channel.

2. The tool of claim 1, wherein said recess includes at least one stud disposed for contactable engagement with a gripping material of said golf club grip.

3. The tool of claim 1, wherein said tool member is pivotally attached to said body member at said body member first surface.

4. The tool of claim 3, wherein said tool member comprises a base member and a protrusion member, wherein said protrusion member is fixedly connected to said base member about a first edge of said base member such that said protrusion member is angularly offset from a first reference plane defined by a first planar surface of said tool member.

5. The tool of claim 3, wherein said tool member is movable about said pivotal attachment between a first position in which said tool member is substantially parallel with said golf club grip and a second position in which said tool member extends beyond a golf club first end distal to a golf club head while in said second position.

6. The tool of claim 1, wherein said fastener member second end includes a series of angled indentations.

7. The tool of claim 6, wherein said body member includes said channel for non-removable capture of said fastener member second end upon advancement of at least one of said series of angled indentations into said channel.

8. A tool attachable to a grip of a golf club, comprising:

a body member, wherein said body member includes a concave recess disposed in a receiving surface of said body member, and wherein said recess includes at least one stud;

a tool member disposed on an exposed surface of said body member; and a fastener member, wherein said fastener member includes a fastener member first end and a fastener member second end, and wherein said fastener member is connected to said body member at said fastener member first end, wherein said body member includes a channel for non-removable capture of said fastener member second end upon advancement of said fastener member second end into said channel.

9. The tool of claim 8, wherein said body member includes at least one open port transverse to said exposed surface.

10. The tool of claim 8, wherein said tool member is pivotally attached to said body member at said body member exposed surface.

11. The tool of claim 10, wherein said tool member comprises a base member and a protrusion member, and wherein said protrusion member is fixedly connected to said base member about a first edge of said base member such that said protrusion member is angularly offset from a first reference plane defined by a first planar surface of said tool member.

12. The tool of claim 10, wherein said tool member is movable about said pivotal attachment between a first position in which said tool member is substantially parallel with said body member and a second position in which said tool member extends beyond a golf club first end distal to a golf club head.

13. The tool of claim 8, wherein said fastener member includes a series of angled indentations between said fastener member first end and said fastener member second end.

14. The tool of claim 13, wherein said body member includes said channel for non-removable capture of said fastener member second end upon advancement of at least one of said series of angled indentations into said channel.

* * * * *